US009322544B2

(12) United States Patent
Carriere

(10) Patent No.: US 9,322,544 B2
(45) Date of Patent: Apr. 26, 2016

(54) PRESSURE ACTIVATED ILLUMINATING WRISTBAND

(71) Applicant: Leena Carriere, Olympia, WA (US)

(72) Inventor: Leena Carriere, Olympia, WA (US)

( * ) Notice: Subject to any disclaimer, the term of this patent is extended or adjusted under 35 U.S.C. 154(b) by 0 days.

(21) Appl. No.: 13/958,232

(22) Filed: Aug. 2, 2013

(65) Prior Publication Data

US 2014/0043794 A1 Feb. 13, 2014

Related U.S. Application Data

(60) Provisional application No. 61/681,439, filed on Aug. 9, 2012.

(51) Int. Cl.

| | |
|---|---|
| ***F21V 21/08*** | (2006.01) |
| ***F21V 33/00*** | (2006.01) |
| ***A44C 5/00*** | (2006.01) |
| ***A44C 15/00*** | (2006.01) |

(52) U.S. Cl.

CPC ..... *F21V 33/0008* (2013.01); *A44C 5/0007* (2013.01); *A44C 15/0015* (2013.01)

(58) Field of Classification Search

CPC ..... F21V 33/0008; A44C 5/0007; A44C 15/0015

USPC ..... 362/103

See application file for complete search history.

(56) References Cited

U.S. PATENT DOCUMENTS

| | | | | |
|---|---|---|---|---|
| 6,213,619 | B1 * | 4/2001 | Yu | A45F 5/02 116/DIG. 44 |
| 6,799,861 | B2 * | 10/2004 | Naghi et al. | 362/198 |
| 7,815,334 | B2 * | 10/2010 | Sherman | A45F 5/00 224/219 |
| 2005/0018546 | A1 * | 1/2005 | Galli | 368/227 |
| 2006/0198120 | A1 * | 9/2006 | Guzman | 362/103 |
| 2006/0199659 | A1 * | 9/2006 | Caldwell | 473/221 |
| 2007/0247839 | A1 * | 10/2007 | Matthews et al. | 362/205 |
| 2009/0207594 | A1 * | 8/2009 | Frick | 362/157 |
| 2009/0265971 | A1 * | 10/2009 | Cook | 40/633 |
| 2010/0066664 | A1 * | 3/2010 | Son et al. | 345/156 |
| 2010/0309755 | A1 * | 12/2010 | Kitahara et al. | 368/282 |
| 2013/0142016 | A1 * | 6/2013 | Pozzo Di Borgo | G04C 3/002 368/82 |

FOREIGN PATENT DOCUMENTS

JP 2005352739 A * 12/2005

* cited by examiner

*Primary Examiner* — Bao Q Truong
*Assistant Examiner* — Hana Featherly
(74) *Attorney, Agent, or Firm* — Christensen O'Connor Johnson Kindness PLLC

(57) ABSTRACT

An apparatus for illuminating an area of interest of a user is provided. The apparatus is received by the user's wrist and oriented such that the area of interest is illuminated when pressure is applied to the apparatus. The apparatus includes a band with a power source and an illuminating device, and a pair of switches affixed to an outer portion of the band, each switch able to allow the power source to provide power to the illuminating device when pressure is applied to the switch. The user may maneuver the apparatus and apply pressure to the switch to enable the illuminating device to illuminate the area of interest and release pressure to the switch to disable the illuminating device.

17 Claims, 3 Drawing Sheets

PRESSURE ACTIVATED ILLUMINATING WRISTBAND

RELATED APPLICATION

The application claims priority to provisional patent application U.S. Ser. No. 61/681,439 filed on Aug. 9, 2012, the entire contents of which is herein incorporated by reference.

BACKGROUND

The embodiments herein relate generally to a pressure activated illuminating wristband. More specifically, embodiments of the present invention relate to pressure activated light-emitting diode ("LED") wristband for poker players.

There are several applications where it is desirable to have a wristband with an illuminating device. One area that could benefit from such a device is the poker industry. Poker players often have a difficult time viewing their "hold cards" in a protective manner when they are wearing sunglasses, placed in a dark room or suffer from a condition such as being visually impaired. Therefore, poker players would greatly benefit from a wristband that can illuminate their cards with minimal effort so they can focus on performing their best during the game. Current illuminating wristbands have limitations because they are often activated by a switch and require too much effort on behalf of the user to operate the devices. As a result, these wristbands are undesirable because they require users to manually adjust the illuminating device to turn on and off via a switch. This operation distracts the users and can have a detrimental effect on their performance. Additionally, the few current illuminating wristbands do not offer a directed focus of light and provide no benefit or aid in viewing a specific target.

As such, there is a need in the industry for an illuminating wristband that allows users to illuminate an area of interest with ease by placing pressure on the wristband.

SUMMARY

An apparatus for illuminating an area of interest of a user, the apparatus configured to be received by the user's wrist and oriented such that the area of interest is illuminated when pressure is applied to the apparatus is provided. The apparatus comprises a band comprising a power source and an illuminating device and a pair of switches affixed to an outer portion of the band, each switch configured to allow the power source to provide power to the illuminating device when pressure is applied to the switch, wherein the user may maneuver the apparatus and apply pressure to the switch to enable the illuminating device to illuminate the area of interest and release pressure to the switch to disable the illuminating device.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
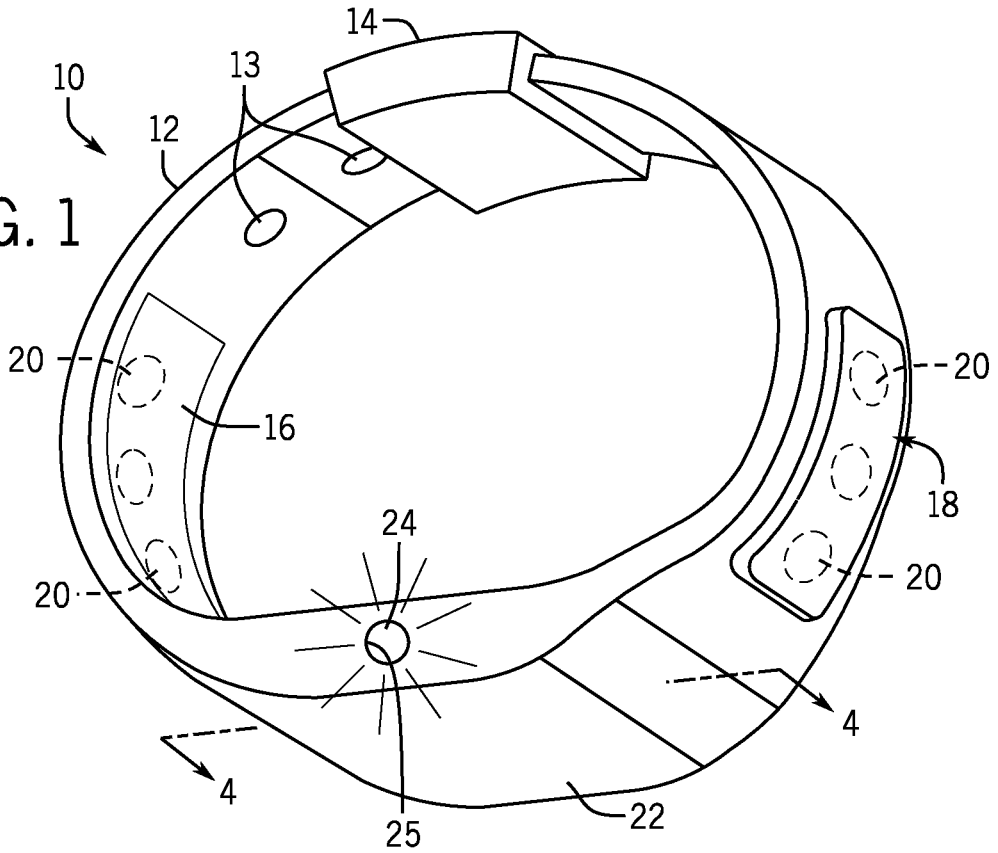
FIG. 1 depicts a schematic perspective view of certain embodiments of the invention.
Figure 2:
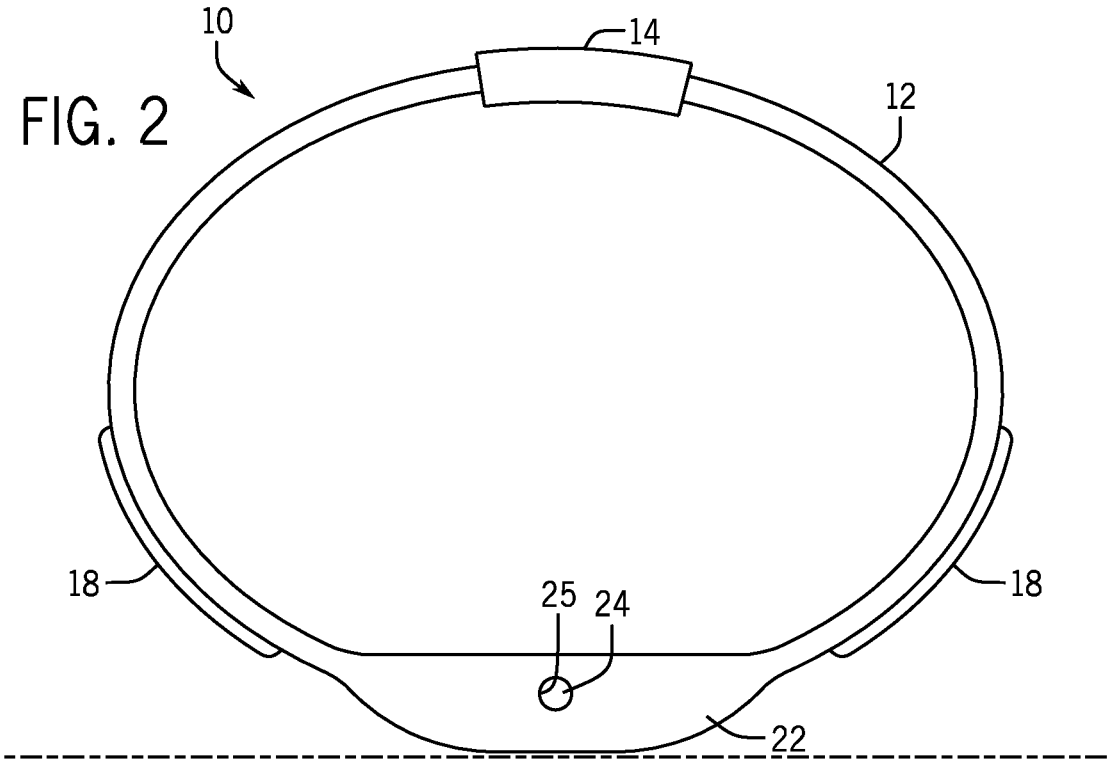
FIG. 2 depicts a side view of certain embodiments of the invention.

FIGS. 1-2 depict certain embodiments of the invention. Apparatus 10 comprises band 12, apertures 13, clasp 14, inner cover 16, switches 18, switch nubs 20, component compartment 22, LED 24, and LED aperture 25. It shall be appreciated that LED 24 may be replaced with any other type of illuminating device known in the field.

Band 12 may comprise any materials known in the field including, but not limited to synthetic silicon, also known as silicon rubber. Band 12 may be adjusted to fit a user's wrist via apertures 13 and clasp 14. Clasp 14 is constructed from stainless steel and contains a fastening component such as a button system, which is similar to a ball cap. Clasp 14 is fastened and closed at one of apertures 13. LED 24 is a 3 mm, 2 lumen LED with a viewing angle of 30 degrees. This allows apparatus 10 to direct light towards an area of interest while using a lower output light to accomplish the same lighting as a wider viewing angled LED.

Figure 3:
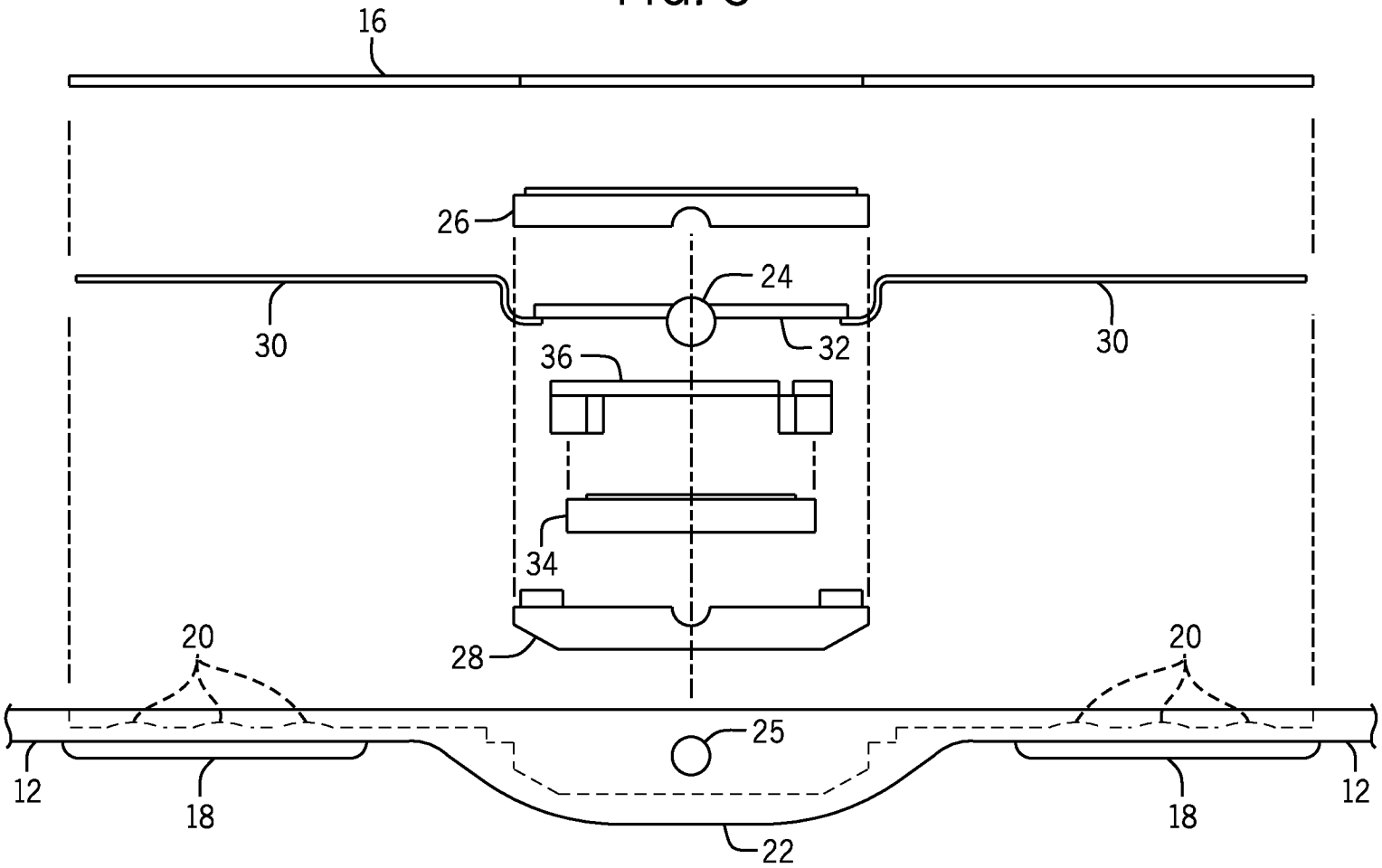
FIG. 3 depicts an exploded elevation view of certain embodiments of the invention.
Figure 4:
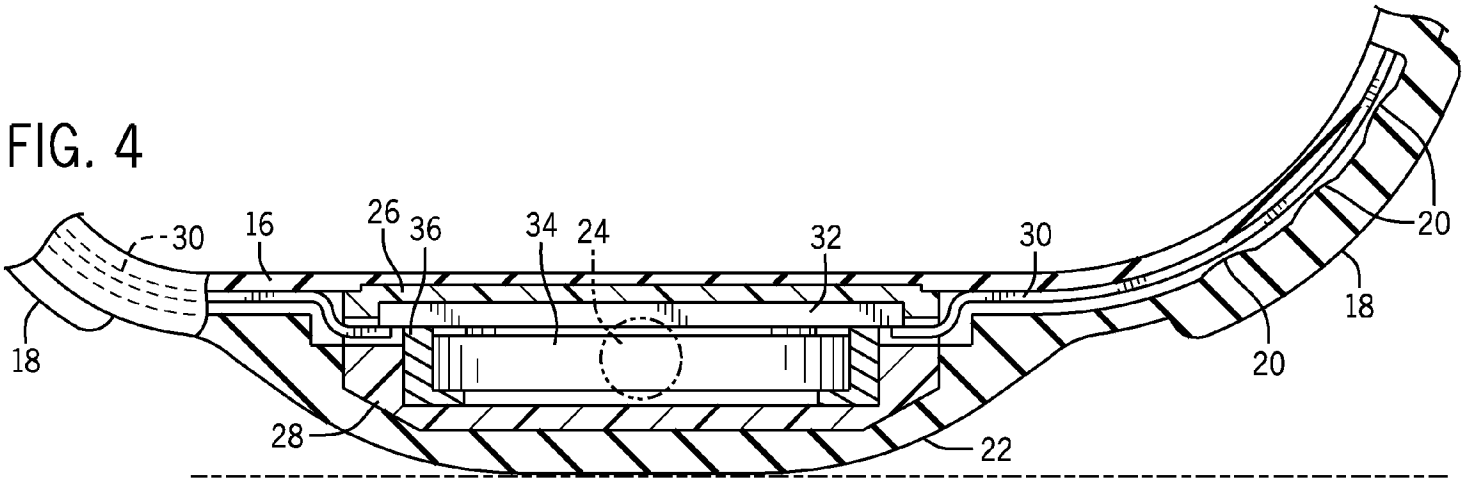
FIG. 4 depicts a sectional view of certain embodiments of the invention.
Figure 5:
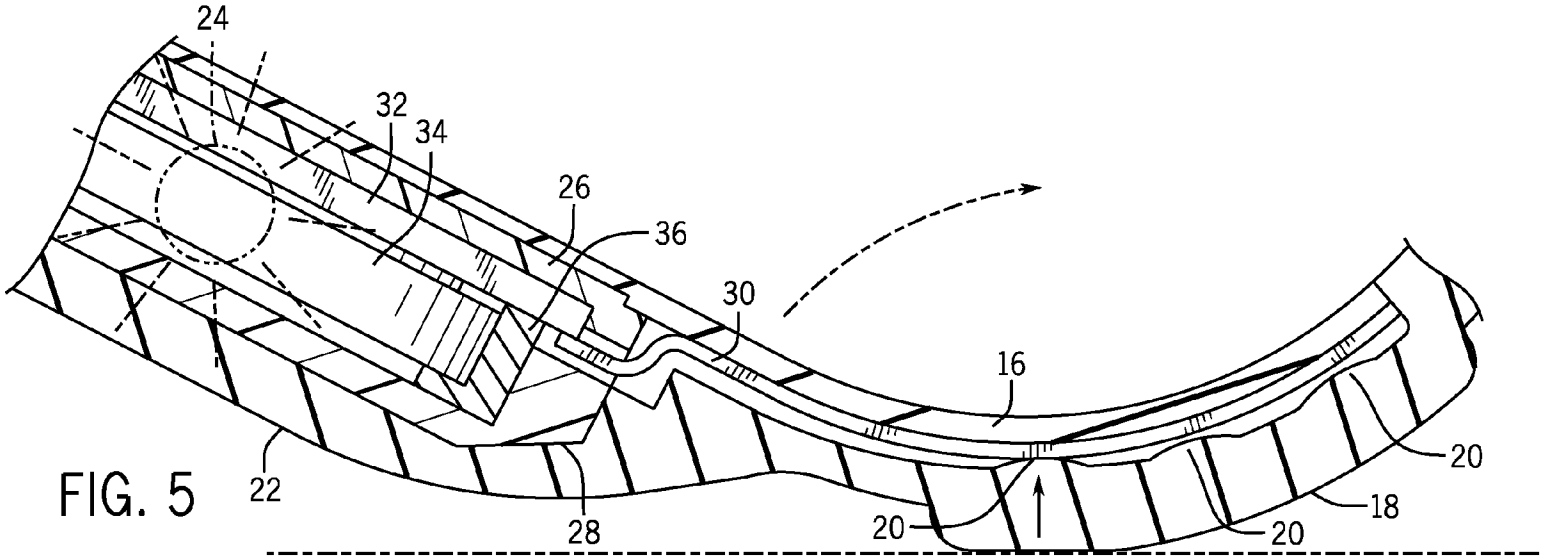
FIG. 5 depicts a sectional view of certain embodiments of the invention.

FIGS. 3-5 depict certain interior components of apparatus 10 in accordance with certain embodiments of the invention. Apparatus 10 comprises interior base 26, interior cover 28, switch elements 30, printed circuit board 32, battery 34 and battery drawer 36. Battery 34 is a CR 2032 lithium battery. However, it shall be appreciated that any alternative type of battery may be used with apparatus 10.

Switches 18, switch nubs 20, switch elements 30, printed circuit board 32 and battery 34 enable LED 24 to illuminate when switch elements 30 receives pressure or a force. Generally, switch elements 30 activates LED 24 with a force in the range of 0.1-10 newtons. This allows the weight of a user's hand to provide sufficient force to activate the LED. Circuit board 32 contains a mount for LED 24 and pressure sensors that work in conjunction with switches 18, switch nubs 20 and switch elements 30. The pressure sensors comprise force sensitive resistors, which vary the resistance in the circuit depending on the force applied to the resistors. As a result, the brightness of the LED output will vary depending on the amount force a user places on the switch, i.e., the greater the force, the brighter the LED. The range of resistance in the switch will be 1 milliohm with no pressure and 2.5 kilo ohms with full pressure being applied. It shall be appreciated that apparatus 10 is not limited to pressure switches and may also include a toggle on/off switch.

In operation, users adjust band 12 on their wrists using apertures 13 and clasp 14. Users will place pressure on one or both of switches 18 to activate LED 24, which can be oriented to illuminate an area of interest. LED 24 is illuminated until the user discontinues pressure on switch 18. As a result, poker players can easily view their "hold cards" under poorly lit conditions by pushing switch 18 of band 12 against the table. This activates LED 24 and the user can orient band 12 so the cards are illuminated.

In an alternate embodiment, components of the pressure activated illuminating apparatus may be incorporated into any other user wearable devices, including, but not limited to, watches, MP3 players or other portable devices.

It shall be appreciated that the components of the pressure activated illuminating apparatus described in several embodiments herein may comprise any known materials in the field and be of any color, size and/or dimensions. This allows the apparatus to accommodate any variety of illuminating devices and be used for any variety of applications. The components of the apparatus may be manufactured using any known techniques in the field such as injection molding and stamping processes.

While the foregoing is directed to embodiments of the present invention, other and further embodiments of the invention may be devised without departing from the basic scope thereof. Furthermore, whereas the multitude of embodiments disclosed herein each provide a variety of elements within each embodiment, it should be appreciated any combination of elements from any combination of embodiments is well within the scope of further embodiments of the present invention.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An apparatus for illuminating an area of interest, the apparatus configured to be received on a user's wrist, the apparatus comprising:

a band having an intermediate section and first and second extending portions that extend from first and second opposite sides of the intermediate section, the intermediate section further including a front face surface, a back surface opposite the front face surface, and third and fourth side surfaces adjacent the front face and the back surfaces, the intermediate section including a power source and a light source, wherein the light source is positioned on the third side surface of the intermediate section; and a pressure sensor positioned on either of the first or second extending portion of the band at a predetermined distance from the light source to provide power to the light source.

2. The apparatus of claim 1, further comprising two pressure sensors positioned on each of the first or second extending portions of the band at a predetermined distance from the light source to provide power to the light source.

3. The apparatus of claim 1, wherein the light source is radiating in a first state and non-radiating in a second state.

4. The apparatus of claim 3, wherein the light source transmits light to the area of interest in the user's hand when the light source is in the first state.

5. The apparatus of claim 1, wherein the light source is positioned normal to an axis extending through the intermediate section and the first and second extending portions.

6. The apparatus of claim 1, wherein the pressure sensor is configured to enable the illuminating device to produce a variable brightness output based on a degree of force placed on the switch.

7. The apparatus of claim 6, wherein the pressure sensor is configured to activate the illuminating device when the degree of force applied to the switch is in the range of 0.1-10 newtons.

8. The apparatus of claim 1, wherein the pressure sensor includes a plurality of nubs.

9. The apparatus of claim 1, wherein the band includes a clasping mechanism.

10. The apparatus of claim 1, wherein the power source includes a battery.

11. The apparatus of claim 1, wherein the band is made from silicone rubber.

12. The apparatus of claim 1, wherein the illuminating device includes a light-emitting diode.

13. The apparatus of claim 1, wherein the light-emitting diode is configured to have a viewing angle of 30 degrees.

14. The apparatus of claim 1, wherein the apparatus further includes a circuit board operably connected to the pressure sensor, the illuminated devise, and the power source.

15. The apparatus of claim 1, wherein the first and second extending portions each have an internal surface configured to contact the user's wrist and an external surface opposite the internal surface, and wherein the a pressure sensor positioned on an external surface of either of the first or second extending portion of the band.

16. An apparatus for illuminating an area of interest, the apparatus configured to be received on a user's wrist, the apparatus comprising:

a band having an intermediate section and first and second extending portions that extend from first and second opposite sides of the intermediate section, the intermediate section further including a front face surface, a back surface opposite the front face surface, and third and fourth side surfaces adjacent the front face and the back surfaces, the intermediate section including a power source and a light source, wherein the light source is positioned on the third side surface of the intermediate section and arranged to transmit light from the third side surface of the intermediate section; and a pressure sensor positioned on an external surface of either of the first or second extending portion of the band at a predetermined distance from the light source to provide power to the light source.

17. An apparatus for illuminating an area of interest, the apparatus configured to be received on a user's wrist, the apparatus comprising:

a band having an intermediate section and first and second extending portions that extend from first and second opposite sides of the intermediate section, the intermediate section further including a front face surface, a back surface opposite the front face surface, and third and fourth side surfaces adjacent the front face and the back surfaces, the intermediate section including a power source and a light source, wherein the light source is positioned on the third side surface of the intermediate section and wherein the light source is positioned to transmit light toward the area of interest in the user's hand; and a pressure sensor positioned on either of the first or second extending portion of the band at a predetermined distance from the light source to provide power to the light source.

* * * * *